US010897072B2

(12) United States Patent
Iannuzzi et al.

(10) Patent No.: US 10,897,072 B2
(45) Date of Patent: Jan. 19, 2021

(54) BALANCE PLATFORM FOR MOBILE ANTENNA

(71) Applicants: Robert N. Iannuzzi, Virginia Beach, VA (US); Aidan J. Cowhig, Arlington, VA (US); Alexander M. Dixon, Fairfield Township, OH (US)

(72) Inventors: Robert N. Iannuzzi, Virginia Beach, VA (US); Aidan J. Cowhig, Arlington, VA (US); Alexander M. Dixon, Fairfield Township, OH (US)

( * ) Notice: Subject to any disclaimer, the term of this patent is extended or adjusted under 35 U.S.C. 154(b) by 0 days.

(21) Appl. No.: 16/583,354

(22) Filed: Sep. 26, 2019

(65) Prior Publication Data

US 2020/0119427 A1 Apr. 16, 2020

Related U.S. Application Data

(60) Provisional application No. 62/738,128, filed on Sep. 28, 2018.

(51) Int. Cl.
*H01Q 1/18* (2006.01)

(52) U.S. Cl.
CPC ..... *H01Q 1/18* (2013.01)

(58) Field of Classification Search
CPC ..... H01Q 1/12; H01Q 1/18
See application file for complete search history.

(56) References Cited

U.S. PATENT DOCUMENTS 3,860,931 A * 1/1975 Pope ..... H01Q 1/18 343/709
5,512,912 A * 4/1996 Ross ..... H01Q 1/18 343/709
2014/0366930 A1* 12/2014 Desaut ..... F24S 30/45 136/248

FOREIGN PATENT DOCUMENTS

WO WO-9308614 A1 * 4/1993 ..... H01Q 1/18

* cited by examiner

*Primary Examiner* — Hoang V Nguyen

(57) ABSTRACT

A stabilization adapter is provided for a portable antenna. The adapter includes a clamp, a rod and a counterweight. The clamp connects to a stand of the antenna. The rod adjustably attaches at its proximal end to the clamp. The counterweight attaches the rod at its distal end.

2 Claims, 10 Drawing Sheets

BALANCE PLATFORM FOR MOBILE ANTENNA

CROSS REFERENCE TO RELATED APPLICATION

Pursuant to 35 U.S.C. § 119, the benefit of priority from provisional application 62/738,128, with a filing date of Sep. 28, 2018, is claimed for this non-provisional application.

STATEMENT OF GOVERNMENT INTEREST

The invention described was made in the performance of official duties by one or more employees of the Department of the Navy, and thus, the invention herein may be manufactured, used or licensed by or for the Government of the United States of America for governmental purposes without the payment of any royalties thereon or therefor.

BACKGROUND

The invention relates generally to mobile antenna platforms. In particular, the invention relates to counterweight attachments to improve antenna balance stability.

The AV 2040 portable ultra-high frequency (UHF) satellite communication (SATCOM) antenna is used for in situ communication, including military personnel on deployment. The AV 2040 attaches to a tripod and can be folded for stowage and human-carry transport. Trivec-Avant manufacturers a commonly used version.

SUMMARY

Conventional portable antenna mounts yield disadvantages addressed by various exemplary embodiments of the present invention. In particular, various exemplary embodiments provide a stabilization adapter for a portable antenna. The adapter includes a clamp, a rod and a counterweight. The clamp connects to a stand of the antenna. The rod adjustably attaches at its proximal end to the clamp. The counterweight attaches the rod at its distal end.

BRIEF DESCRIPTION OF THE DRAWINGS

These and various other features and aspects of various exemplary embodiments will be readily understood with reference to the following detailed description taken in conjunction with the accompanying drawings, in which like or similar numbers are used throughout, and in which.

DETAILED DESCRIPTION

In the following detailed description of exemplary embodiments of the invention, reference is made to the accompanying drawings that form a part hereof, and in which is shown by way of illustration specific exemplary embodiments in which the invention may be practiced. These embodiments are described in sufficient detail to enable those skilled in the art to practice the invention. Other embodiments may be utilized, and logical, mechanical, and other changes may be made without departing from the spirit or scope of the present invention. The following detailed description is, therefore, not to be taken in a limiting sense, and the scope of the present invention is defined only by the appended claims.

The disclosure generally employs quantity units with the following abbreviations: length in feet (ft) or inches (in), mass in pounds (lb), time in seconds (s), angles in degrees (°) and frequency in mega-hertz (MHz).

The AV2040 and many similar antennas have a significant stability shortcoming when subjected to both internal and external forces. Some manufacturers have tried to solve this problem hanging a "hammock" style pouch under the antenna to lower the center of gravity and prevent subsequent instability. This conventional solution necessitates disassembly, resulting in scattered and displaced components.

As an expedient substitute, operators search for random objects to "weigh down" the antenna. Often the hammock does not provide sufficient support when installed. In such circumstances, operators resort to disposing sandbags around the base of the antenna, against the legs to prevent movement of the antenna itself. In an expeditionary "on the move" environment, such resources are not always readily available, leaving the operator with an unstable equipment item that can degrade mission performance and capability. Exemplary embodiments provide an integrated solution that requires neither removal nor additional resources that could be misplaced or broken.

Figures 1A, 1B, 1C:
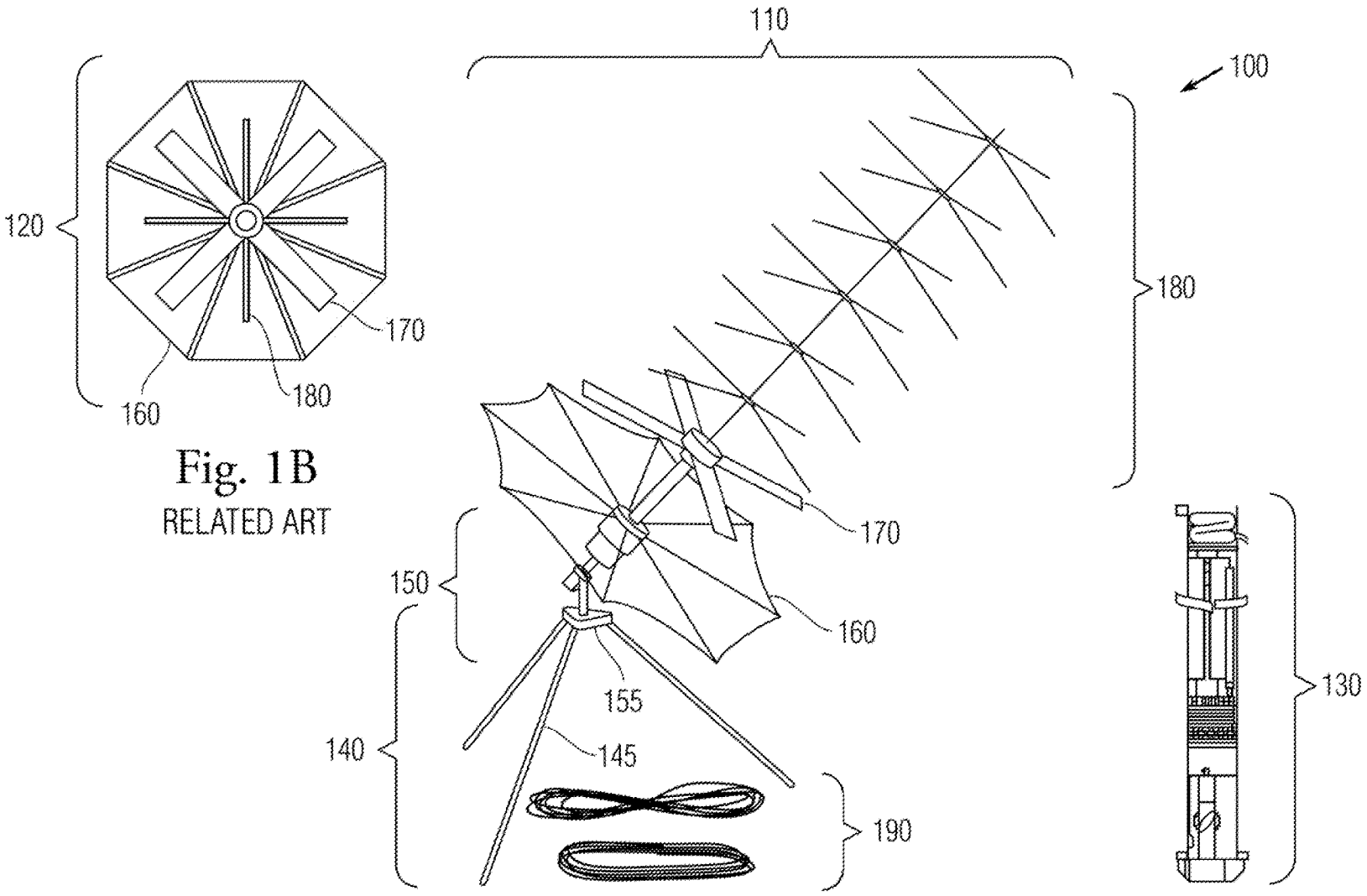
Fig. 1A RELATED ART
Fig. 1B RELATED ART
FIGS. 1A, 1B and 1C show a set of views 100 of a mobile antenna.

FIGS. 1A, 1B and 1C show a set of views 100 of a foldable high-gain AV 2040 SATCOM antenna system 110 in relation to exemplary mount embodiments. FIG. 1A shows a perspective view of the antenna system 110 as deployed, weighing 6½ lb. FIG. 1B shows a plan view of the antenna mast 120. FIG. 1C shows an elevation view of the antenna system 110 as stowed 130, with a length of 18½ in and a diameter of 4¾ in.

The mast 120 attaches to a tripod 140 with three legs 145 supporting a transceiver assembly 150 with a head 155 on which the legs 145 pivotably attach. The tripod 140 constitutes a typical light-weight standing platform for mobile communications equipment. The mast 120 includes an umbrella 160, a blade cruciform 170 and a boom 180. The umbrella 160 extends radially about two feet. The antenna 110 can further include cables 190 and an apron with hooks for attachment to the legs 145. The antenna 110 operates at a frequency between 240 MHz and 400 MHz in the UHF band.

Figure 2:
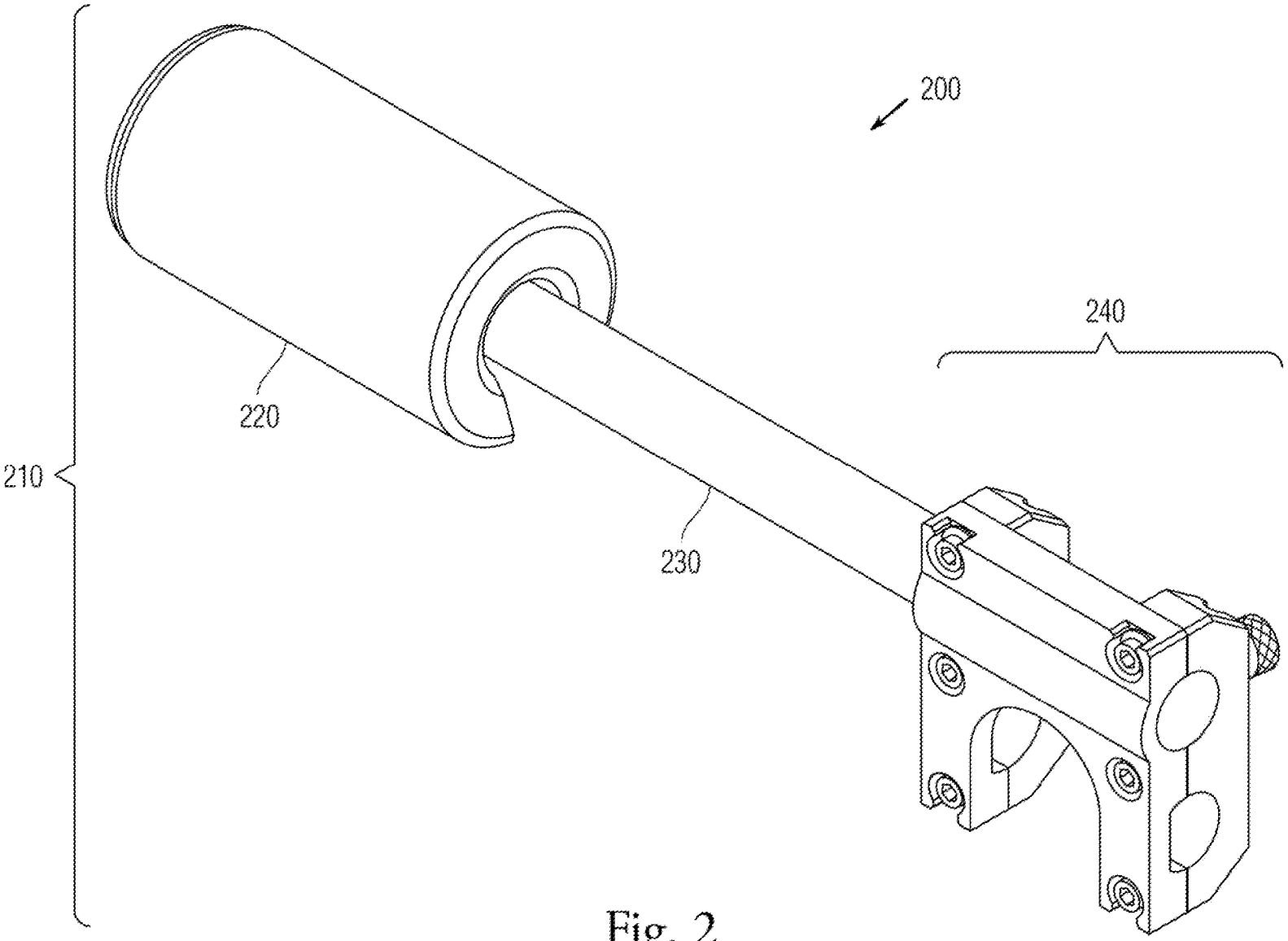
FIG. 2 shows an isometric assembly view of an exemplary adapter.

FIG. 2 shows an isometric assembly view 200 of an exemplary stabilization adapter 210. This includes a cantilever sleeve 220, a connection rod 230, and a clamp 240. The sleeve 220 provides a counterweight for the antenna 110. The rod 230 connects to the clamp 240 at its proximal end, and to the sleeve 220 at its distal end. The adapter 210 enables the antenna 110 to be counterbalanced.

Figure 3:
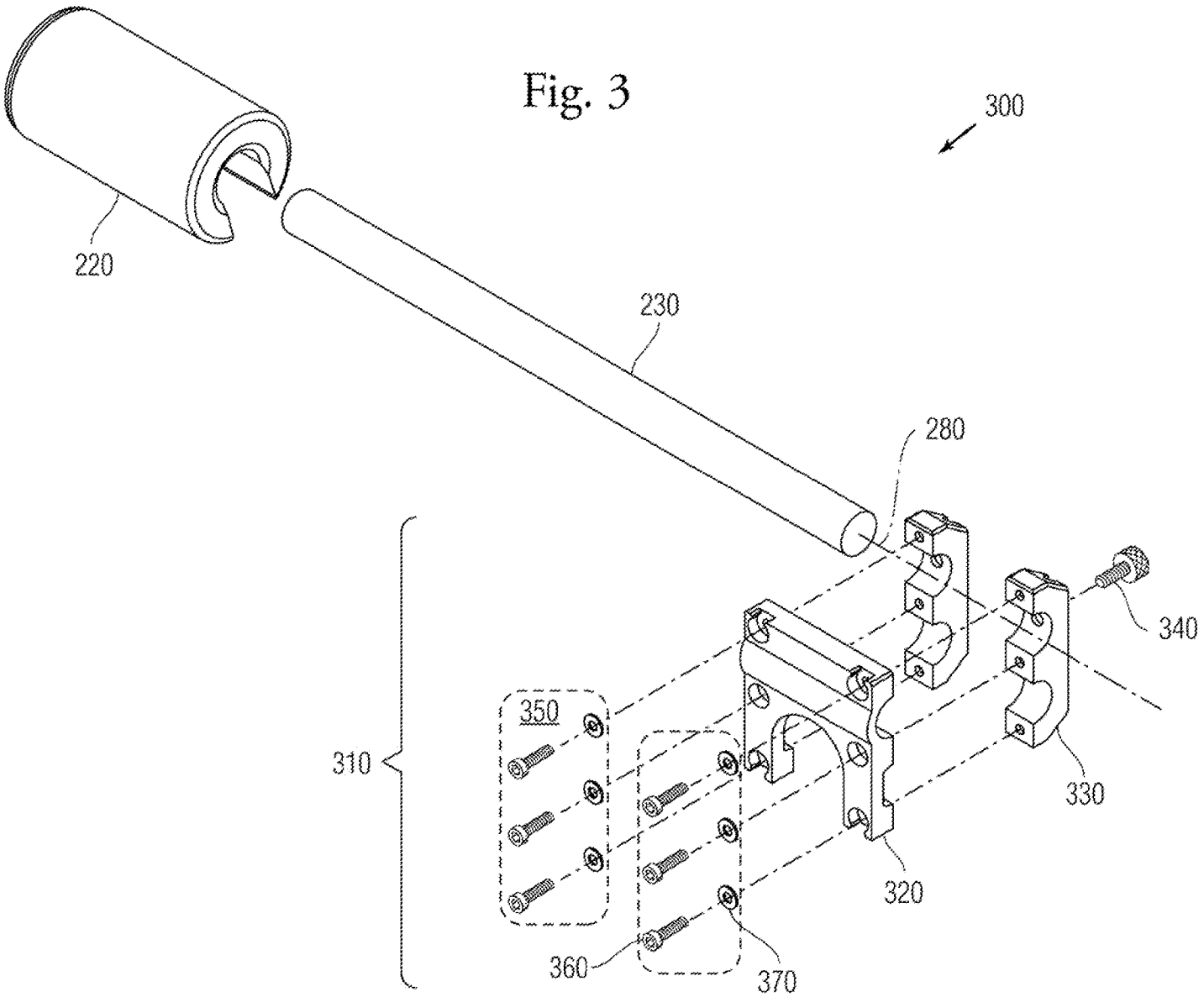
FIG. 3 shows an isometric exploded view of adapter components.

FIG. 3 shows an isometric exploded view 300 of adapter components. The sleeve 220 and rod 230 are detached. The clamp 240 is divided into components 310. The rod 230 is secured between a receiver plate 320 and a pair of coupler pads 330. The rod 230 is tightened by a set screw 340 through one or both pads 330. The plate 320 and pads 330 are secured by a series 350 of bolts 360 and washers 370. The rod 230 has a longitudinal axis 380 to which the plate 320 and pads 330 align in parallel.

Figure 4:
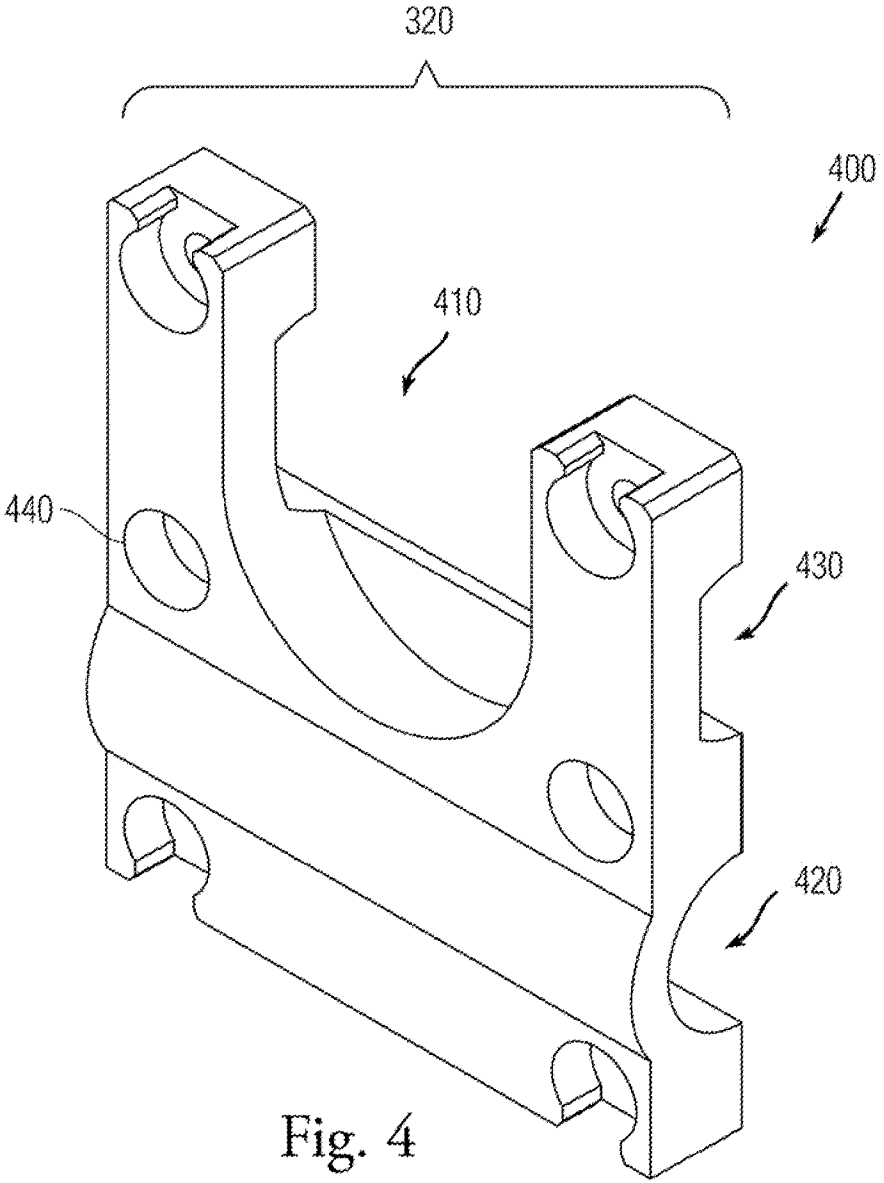
FIG. 4 shows an isometric view of the base plate.

FIG. 4 shows an isometric view 400 of the receiver plate 320. A horseshoe arch 410 enables a segment of the mast 120 to be received. A semicircular channel 420 receives the rod 230. Chamfers 430 provide cavities in the arch 410 for affixing to the antenna mast 120. Orifices 440 enable the bolts 360 to pass therethrough.

Figure 5:
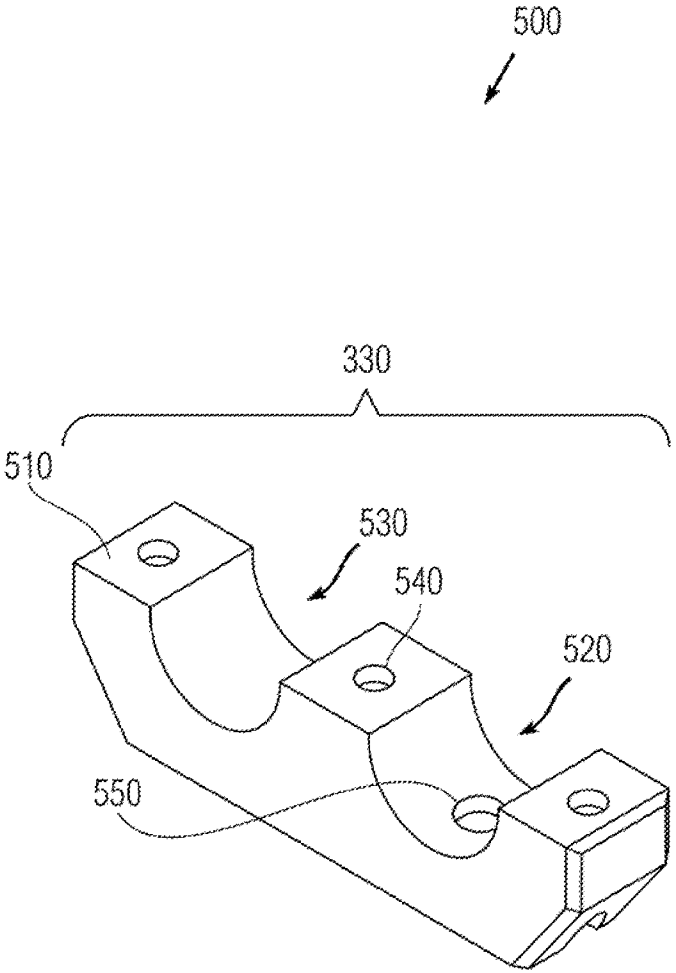
FIG. 5 shows an isometric view of the coupler pad.

FIG. 5 shows an isometric view 500 of the coupler pad 330 with interface surfaces 510 that mate against the plate 320. A semicircular channel 520 receives the rod 230 opposite the channel 420. A supplemental channel 530 afixes to the mast 120. Cavities 340 enable the bolts 360 to insert therein. An orifice 550 enables the set screw 340 to pass therethrough.

Figure 7:
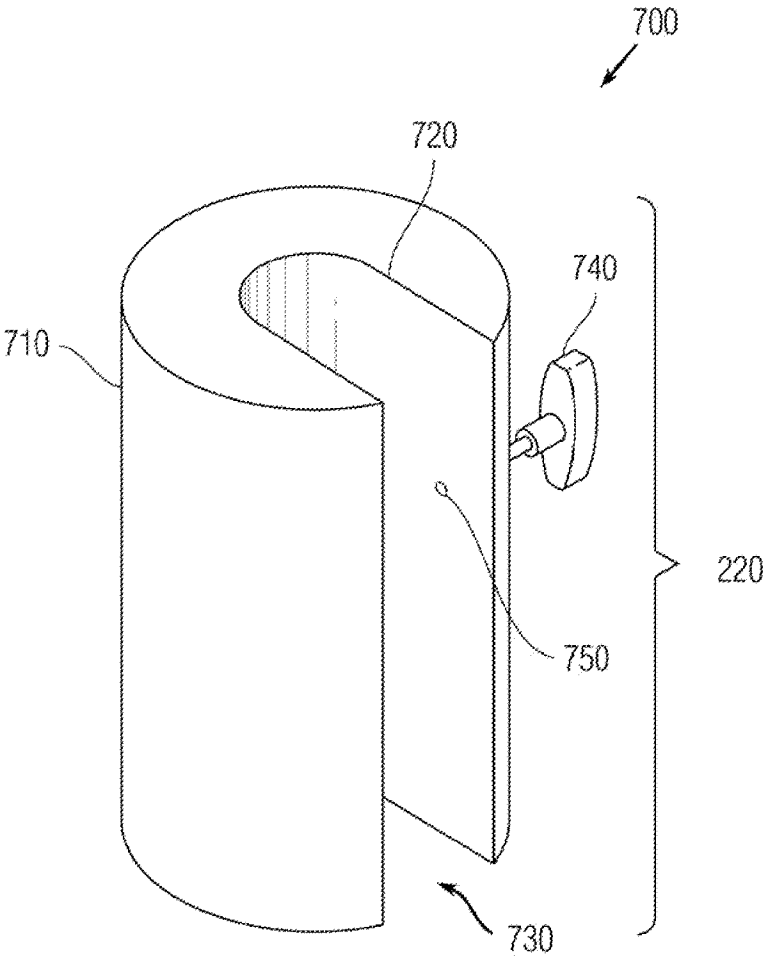
FIG. 7 shows an isometric view of the cantilever sleeve.
Figure 6:
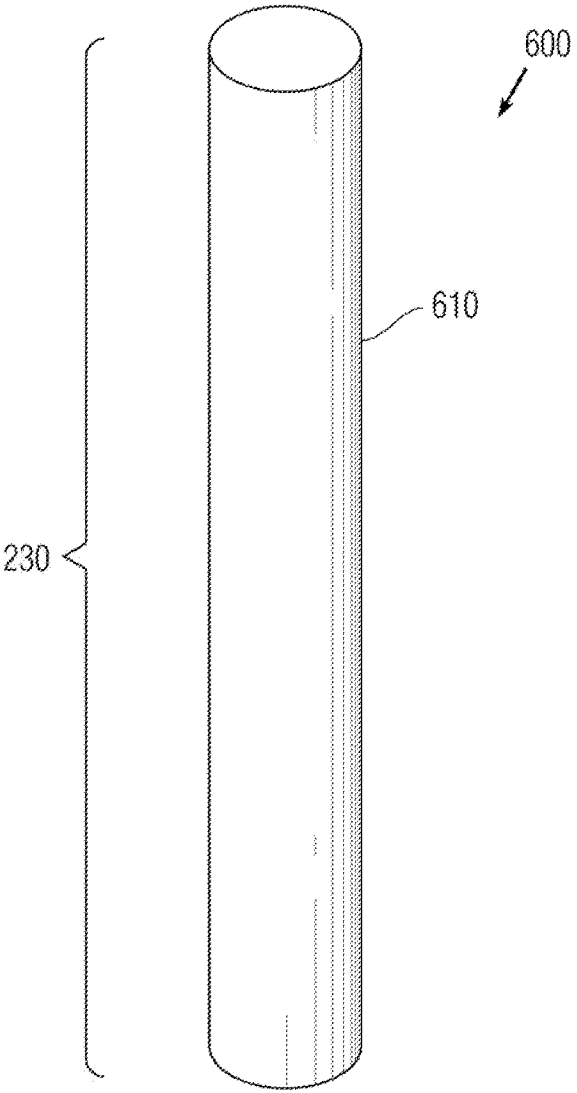
FIG. 6 shows an isometric view of the counterweight rod.

FIG. 6 shows an isometric view 600 of the connection rod 230 that comprises a solid cylinder 610 with a length of one foot and a diameter of ¾ in. FIG. 7 shows an isometric view 700 of the cantilever sleeve 220. A partial cylinder 710 includes a channel border 720 yielding a cavity 730 into which the rod 230 can be inserted, and locked by a butterfly knob 740 that extends into a hole 750 in the cavity 730.

Figure 8:
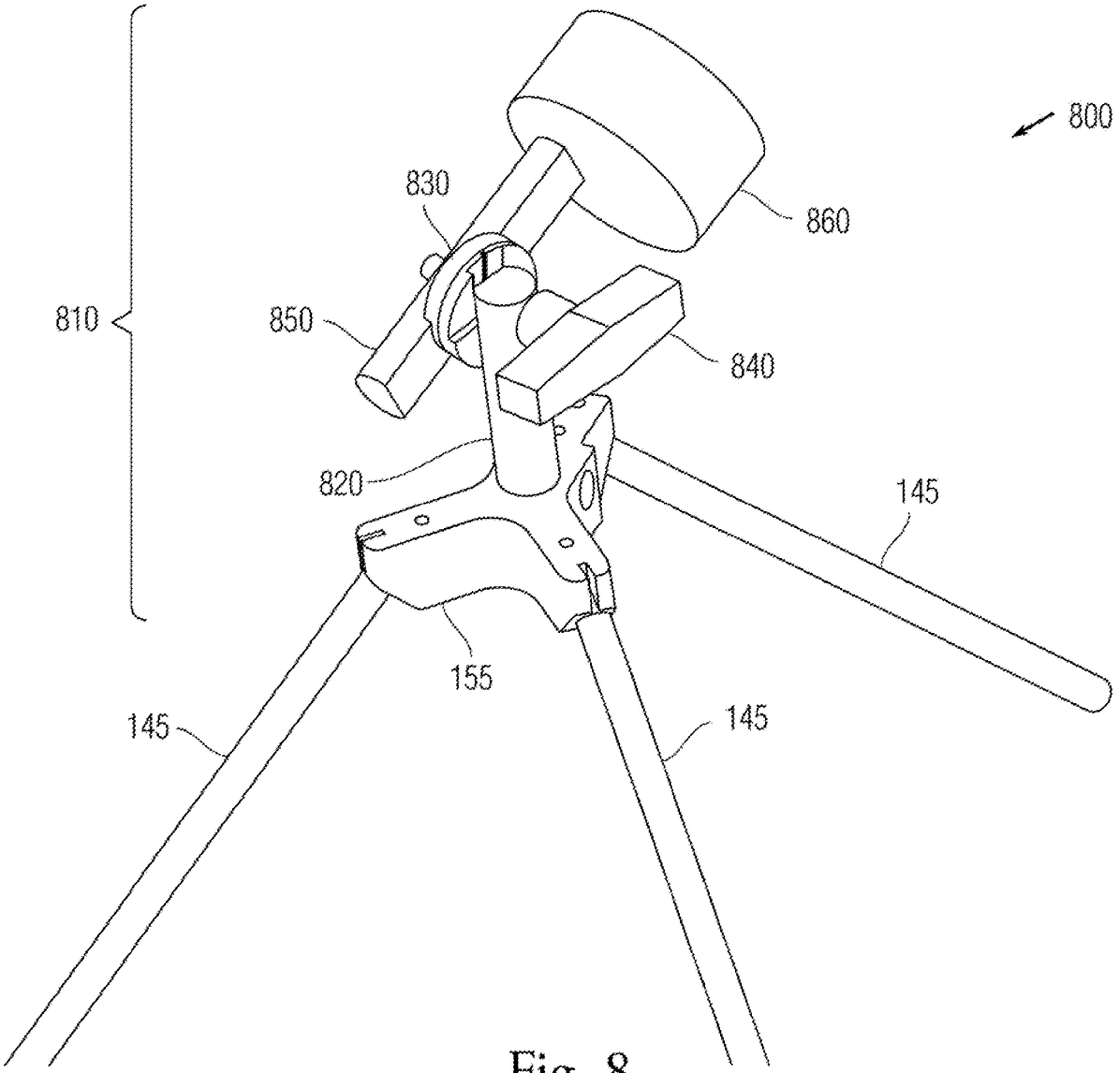
FIG. 8 shows an isometric view of the counterweight assembly.
Figure 9:
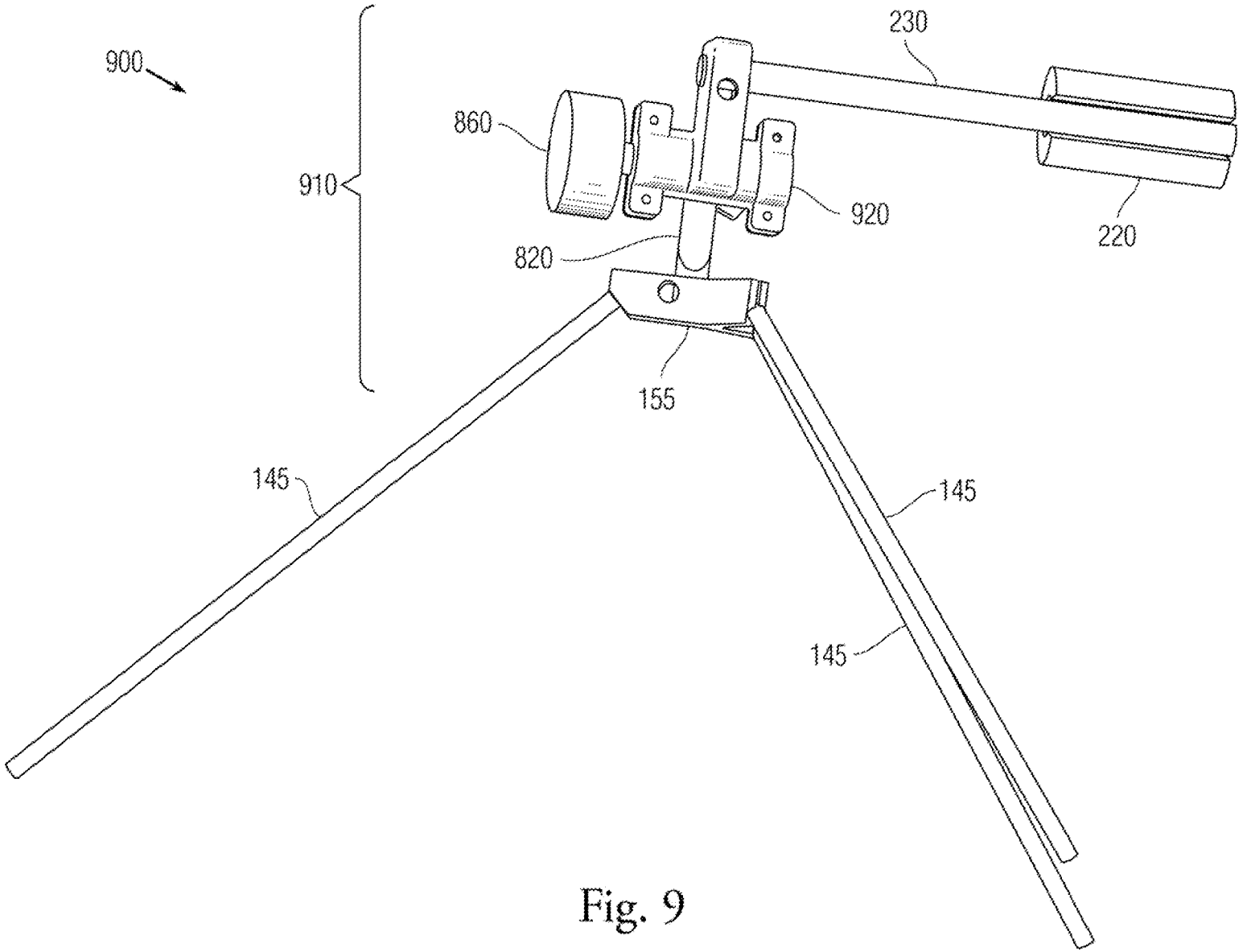
FIGS. 9, 10, 11 and 12 show isometric views of the assembly.

FIG. 8 shows an isometric view 800 of an exemplary stabilizer assembly 810 mounted to the head 155 of the tripod 140. A post 820 attaches to the head 155 as part of the mast 120. An azimuth turn wheel 830 attaches to the post 820 and locks in position with a cinch handle 840. The wheel 830 connects axially to a laterally mounted bottom 850, which attaches to a truncated representation 860 of the mast 120. FIG. 9 shows an isometric view 900 of the stabilizer 810 together with a counterweight assembly 910. A flange 920 connects the rod 230 and sleeve 220 to the post 820.

Figure 10:
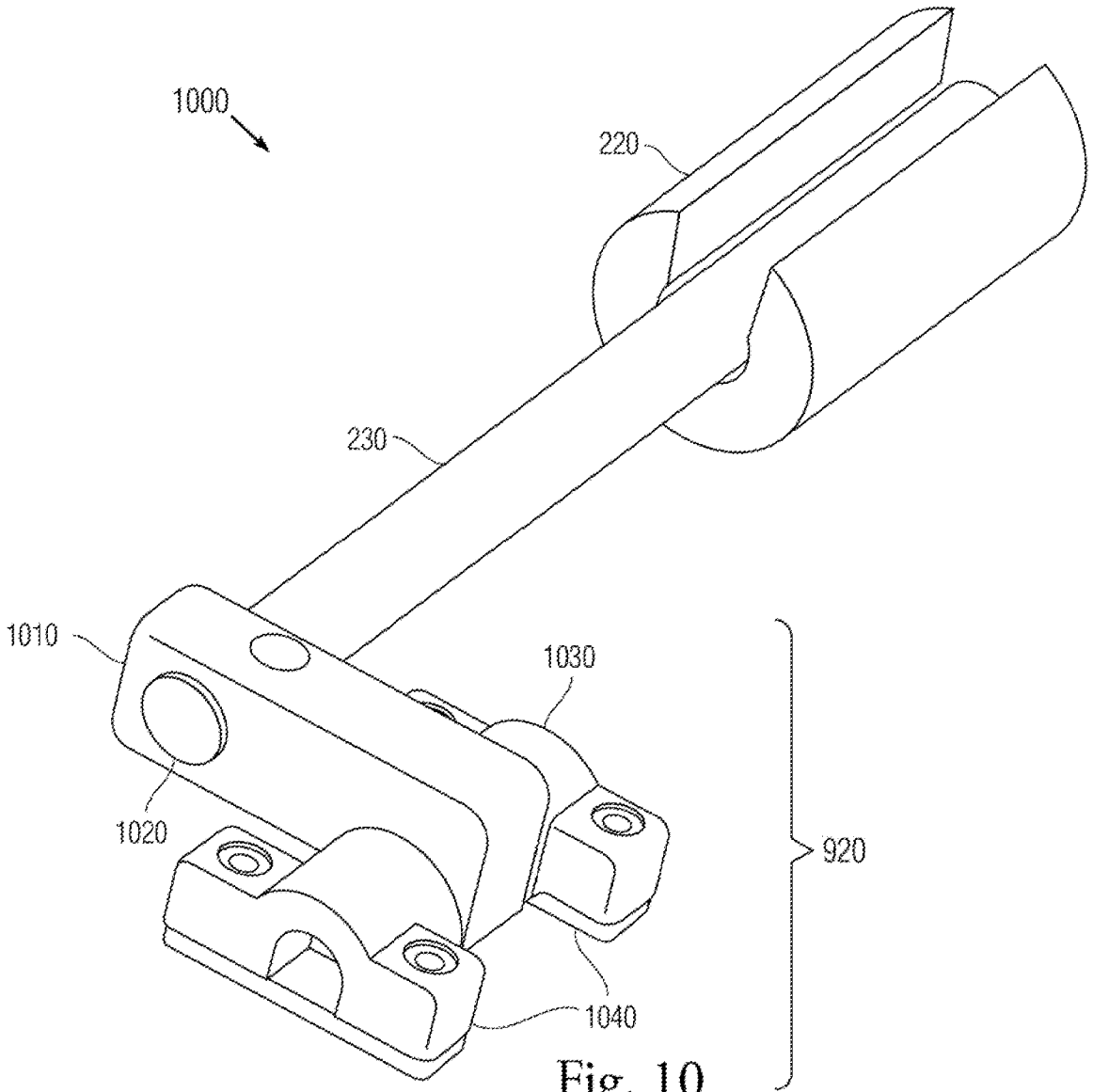
Figure 11:
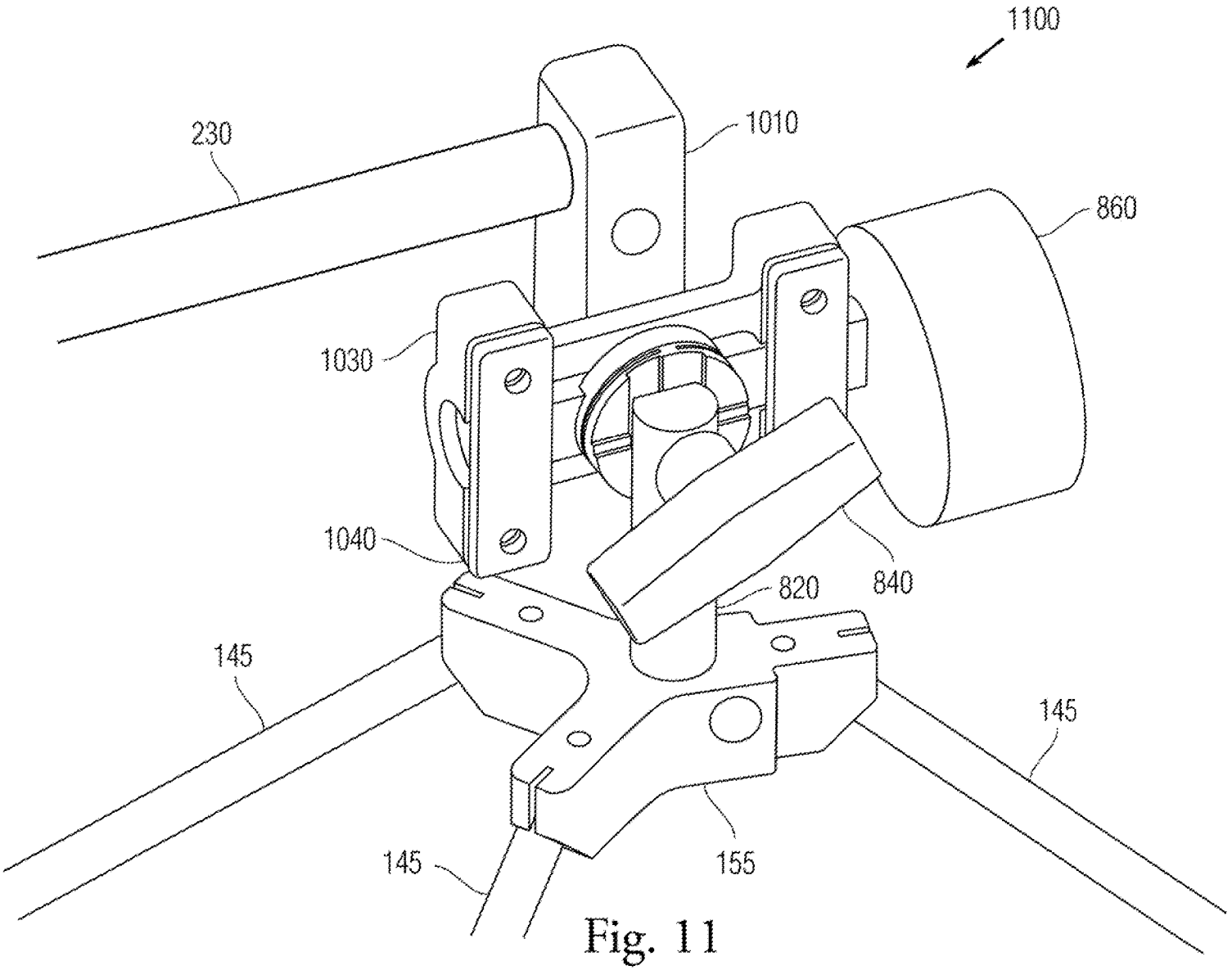
Figure 12:
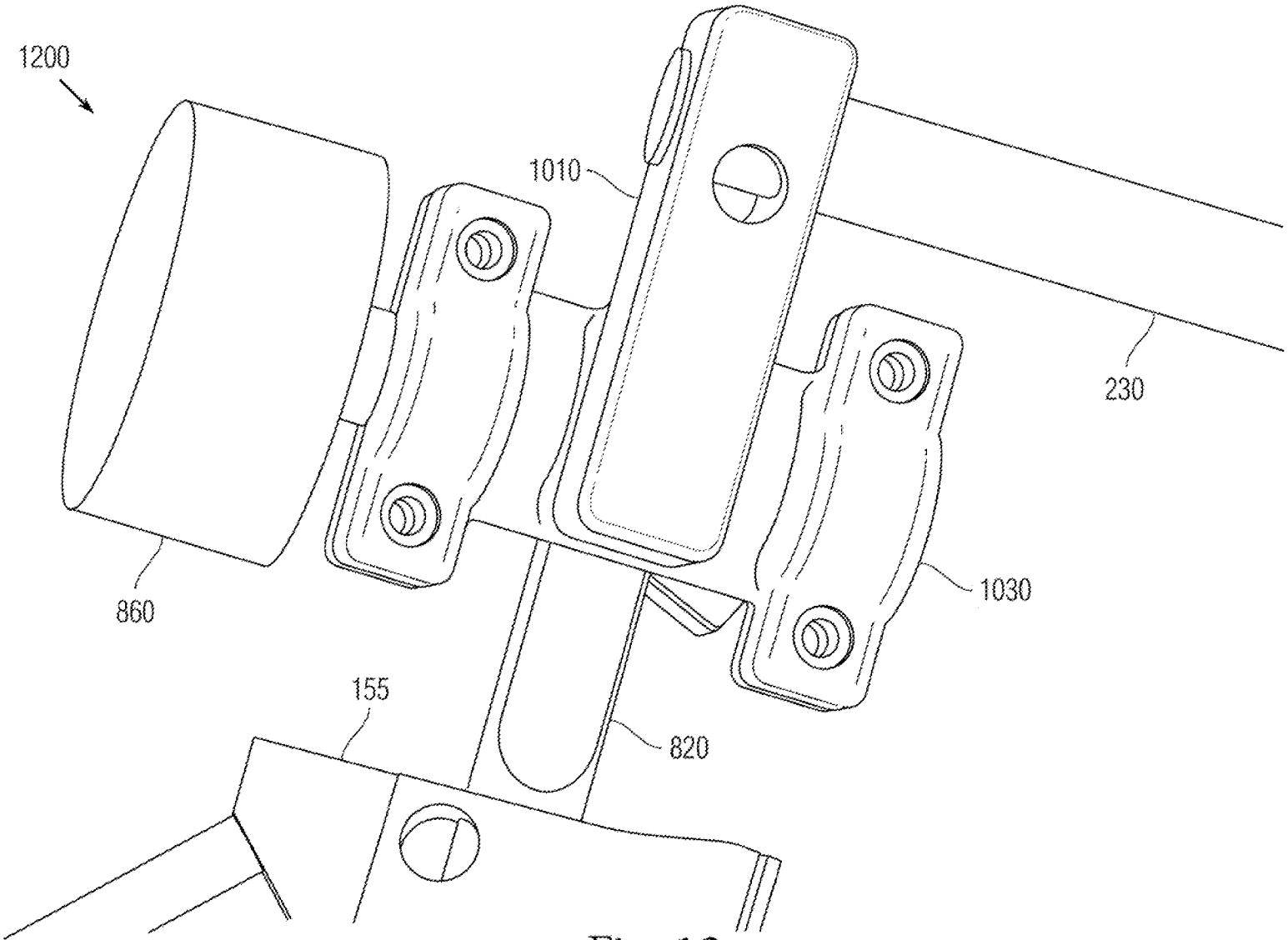

FIG. 10 shows an isometric view 1000 of the flange 920 with the counterweight sleeve 220 and the connection rod 230. The flange 920 includes an exemplary clamping assembly 1010 with a hole 1020 into which the rod 230 can be inserted, as well as a bridge 1030 that clamps against the post 850 and secured by flanges 1040. The hole 1020 corresponds to the joining of cavities 420 and 520. The bridge 1030 denotes legs flanking the horseshoe arch 410 of the plate 320. FIGS. 11 and 12 show further respective isometric views 1100 and 1200 of the flange 920 with the counterweight sleeve 220 and the connection rod 230 in association with components of the mast 120.

To solve the well-known shortcoming of many portable antenna systems, of falling over after setup due to both external (e.g., wind) and internal (i.e., antenna position, gravity, and center of mass) forces. The exemplary integrated counterweight system prevents the antenna 110 from tipping over when subjected to both internal and external forces.

Exemplary embodiments provide an integrated counterweight platform involving a small piece of hardware called a stabilization adapter 210 that attaches (semi-permanently) to the antenna system 110 and can be stored within the current storage bag, box or another medium. The stabilization adapter 210 acts as a fixed junction point between the antenna 110 and a cantilevered weight as the sleeve 220 to offset the frontal load of the antenna mast 120.

The stabilization adapter 210 was designed so as to preclude inhibiting the antenna's movement and adjustability as well as remain relatively small to fit along with antenna 110 within the existing bag. After several iterations, an optimal weight was selected as to not subject the base assembly to any further stress and subsequent degradation.

The stabilization technique is designed to be modular so as the antenna model changes the different components can be swapped in and out to support an infinite number of variations. Once the stabilization adapter 210 attaches to the transceiver assembly 150, the counterweight rod 230 is fixed to extend out along the distal end in the opposite direction of the mast 120. The rod 230 is variable in size and position of the sleeve 220 can be adjusted as needed depending on antenna style and model. The rod 230 should be made of a rigid material to inhibit bending. The sleeve 220 should be made from high-density materials. Metals such as steel and aluminum can be used.

The sleeve 220 should be attach to the rod 230 at the distal end opposite the proximal end of the antenna's fix-point to provide a counterbalance to keep the antenna system 110 as deployed in a state of equilibrium irrespective of the angle-of-attack of the mast 120. The weighted or dense "load" can be either a solid mass or else a hollow cavity in which the operator can source any available material to fill (e.g., water, sand, dirt, rocks). When no longer in operation, the antenna 110 can be quickly broken down and the adapter 210 for counterweighting does not require disassembly or removal.

There are several hundred thousand of the AV-2040 portable antenna in use in the Department of Defense (DoD) alone. Several other federal agencies (FAA, NASA, DHS, etc.) also use this specific antenna. Government contractors also use this antenna in various applications to support government functions. The telecom industry uses similar styled antenna's that could benefit from this innovation. The design and manufacturability of this item can be further optimized for production as well as adaptation to other antenna systems.

Exemplary embodiments provide a low cost, lightweight, integrated, and modular solution to a low tech problem that has been plaguing expeditionary units for years. This will put the government at a strategic advantage over industry counterparts looking to capitalize on a widespread application. This is an improvement over ad hoc alternatives, such as sandbags, and a make-shift hammock that is often lost, damaged, and/or often ineffective.

While certain features of the embodiments of the invention have been illustrated as described herein, many modifications, substitutions, changes and equivalents will now occur to those skilled in the art. It is, therefore, to be understood that the appended claims are intended to cover all such modifications and changes as fall within the true spirit of the embodiments.

What is claimed is:

1. A stabilization adapter for a portable antenna on a stand, said adapter comprising:

a clamp for connecting to the stand;

a rod that adjustably attaches at its proximal end to said clamp; and a counterweight that attaches said rod at its distal end, wherein said clamp has a receiver plate and a pair of coupler pads.

2. The adapter according to claim 1, wherein said clamp includes a first member that connects to the stand and a second member that connects to said rod.

* * * * *